United States Patent [19]

Kowalski

[11] Patent Number: 4,546,026

[45] Date of Patent: Oct. 8, 1985

[54] SIMULATED CASHMERE FABRIC AND METHOD

[75] Inventor: Michael S. Kowalski, Stanely, England

[73] Assignee: Guilford Kapwood Limited, Derbyshire, England

[21] Appl. No.: 558,298

[22] Filed: Dec. 5, 1983

[30] Foreign Application Priority Data

Dec. 3, 1982 [GB] United Kingdom ..... 8234472

[51] Int. Cl.[4] ..... D04B 23/06; D04B 23/08; D06C 13/08; D06C 27/00

[52] U.S. Cl. ..... 428/91; 8/491; 8/494; 8/497; 28/162; 66/194; 428/229; 428/230; 428/231

[58] Field of Search ..... 66/192, 194; 8/491, 8/494, 497; 28/162; 428/229, 230, 231, 91

[56] References Cited

U.S. PATENT DOCUMENTS 3,254,510 6/1966 Lesley .
3,277,673 10/1966 Lesley .
4,298,643 11/1981 Miyagawa et al. ..... 428/229
4,433,493 2/1984 Poisson ..... 66/195

*Primary Examiner*—James C. Cannon
*Attorney, Agent, or Firm*—Oblon, Fisher, Spivak, McClelland & Maier

[57] ABSTRACT

A simulated cashmere fabric comprises a warp knit ground comprising a stretch yarn such as an elastomeric yarn such as Lycra (RTM) and a raised and cropped face. The face yarn may be knitted in over a plurality of, say five, needles, and the fabric may be dyed before the raising and cropping steps and crushed and steamed after.

19 Claims, 2 Drawing Figures

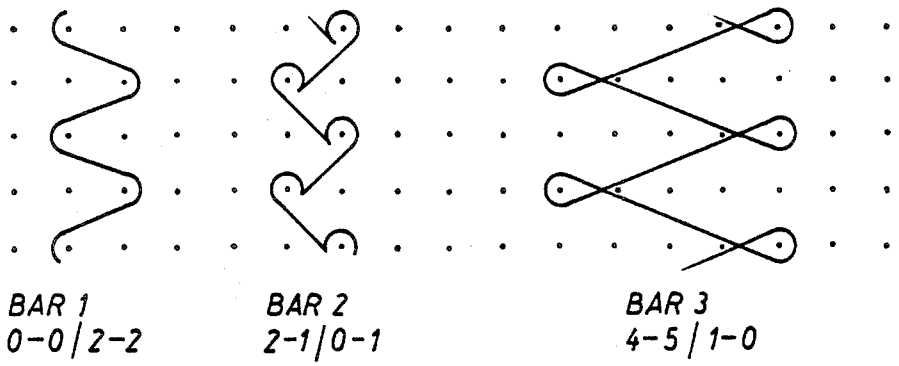
FIG.1
FIG.2
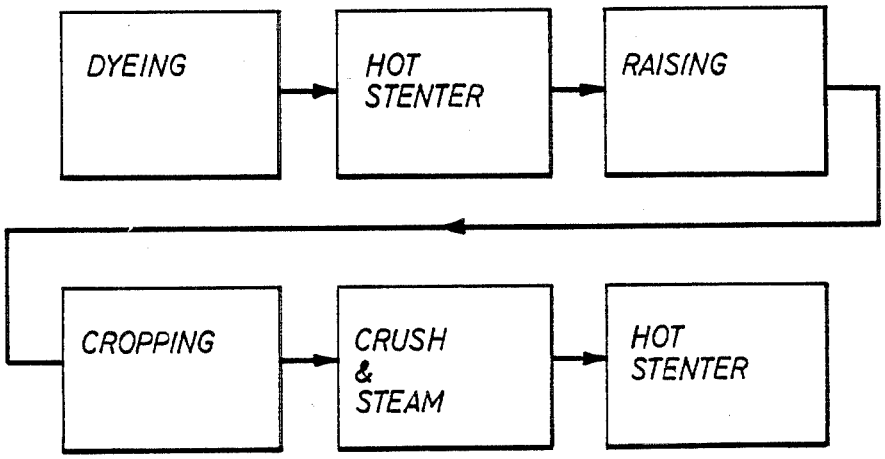

SIMULATED CASHMERE FABRIC AND METHOD

BACKGROUND TO THE INVENTION

This invention relates to simulated cashmere fabric and methods for making the same.

BRIEF DESCRIPTION OF THE INVENTION

The invention comprises a simulated cashmere fabric comprising a warp-knit ground comprising a stretch yarn and a raised and cropped face.

The stretch yarn, may be an elastomeric yarn such as "Lycra" (Registered Trade Mark).

The ground fabric may be a two-bar fabric, and may comprise different yarns.

The ground fabric may comprise a continuous filament yarn, such as polyester, which may be untexturised.

The face yarn may be a continuous filament yarn which may again be an untexturised multifilament polyester yarn.

The face yarn may be knitted over a plurality of needles, for example over five needles.

Preferably, the face yarn is of the same material as is comprised in the fabric, so that the face yarn and one ground yarn can be the same multifilament polyester yarn. The raised and cropped pile, simulating the hairyness of a cashmere fabric, will then dye to the same shade as the ground fabric, giving the effect that the pile is an integral part of the ground fabric.

The invention also comprises a method for making a simulated cashmere fabric comprising warp-knitting a ground fabric together with a face yarn and raising and cropping the face yarn.

The fabric may be dyed before the raising and cropping steps, and may be crushed and steamed after the raising and cropping steps.

BRIEF DESCRIPTION OF THE DRAWINGS

One embodiment of a simulated cashmere fabric and a method for making the same according to the invention will now be described with reference to the accompanying drawings in which:

FIG. 1 is a point pattern diagram showing the motions of the bars of a warp knitting machine for knitting the fabric, and FIG. 2 is a schematic diagram showing the various steps required in cropping and raising and finishing the fabric.

DETAILED DESCRIPTION OF THE PREFERRED EMBODIMENT

A three bar warp knitting mchine is threaded on Bar 1 with a full set of a 44 d/tex "Lycra" (Registered Trade Mark) or similar elastomeric yarn, on Bar 2 and Bar 3 with 76 d/tex 30 filament bright round polyester yarn, full set threading in each case. The motions of the bars set on the pattern chain are illustrated in FIG. 1. Bar 1 lays-in the elastomeric yarn over adjacent needles, Bar 2 knits a tricot base fabric with the laid-in elastomeric yarn, while Bar 3 knits in the face yarn over five needles so that there are long floats of this face yarn which are broken during the raising step and subsequently cropped to leave a fine pile of relatively short "hairs" on the face of the fabric.

As seen in FIG. 2, the knitted fabric, prior to the raising and cropping steps, is dyed. The face yarn and the tricot ground yarn being the same polyester yarn, of course, dye to the same shade. Elastomeric yarns such as "Lycra" (Registered Trade Mark) are temperature-sensitive, so the dyeing should be carried out at a suitably low temperature. Dyeing at less than 115° C. is necessary in the case of "Lycra".

The dyeing step is followed by a hot stentering step, after which the fabric is raised under high tension, then the raised pile cropped. This is followed by a crushing and steaming step, followed by a second hot stentering step. The fabric can then be packed for sale.

Simulated stretch cashmere fabric made as described is suitable inter alia as an automobile upholstery fabric.

I CLAIM:

1. A simulated cashmere fabric comprising a warp-knit ground comprising a stretch yarn and a raised and cropped face.

2. A fabric according to claim 1, in which the stretch yarn comprises an elastomeric yarn.

3. A fabric according to claim 1, in which the ground fabric is a two-bar fabric.

4. A fabric according to claim 1, in which the ground fabric comprises different yarns.

5. A fabric according to claim 1, in which the ground fabric comprises a continuous filament yarn.

6. A fabric according to claim 5, in which the continuous filament yarn is polyester.

7. A fabric according to claim 5, in which the continuous filament yarn is untexturised.

8. A fabric according to claim 1, in which the face yarn is a continuous filament yarn.

9. A fabric according to claim 8, in which the face yarn is an untexturised multifilament polyester yarn.

10. A fabric according to claim 1, in which the face yarn is knitted in over a plurality of needles.

11. A fabric according to claim 10, in which the face yarn is knitted in over five needles.

12. A fabric according to claim 1, in which the face yarn is of the same material as is comprised in the ground.

13. A fabric according to claim 12, in which the face yarn and one ground yarn comprise polyester.

14. A fabric according to claim 1, which has been crushed and steamed after the face has been brushed and cropped.

15. A method for making simulated cashmere fabric comprising warp-knitting a ground fabric from a stretch yarn together with a face yarn and raising and cropping the face yarn.

16. A method according to claim 15, in which the face yarn is the same material as at least one yarn of the ground fabric.

17. A method according to claim 15, in which the ground fabric is knitted from an elastomeric yarn.

18. A method according to claim 15, in which the fabric is dyed prior to the raising and cropping steps.

19. A method according to claim 15, in which the fabric is crushed and steamed after the raising and cropping steps.

* * * * *